United States Patent [19]

Kaarsmaker

[11] 3,952,772

[45] Apr. 27, 1976

[54] INTAKE PIECE ADAPTED FOR EMPTYING CONTAINERS WITH LIQUID

[75] Inventor: Hendrik Kaarsmaker, Herrjansdam, Netherlands

[73] Assignee: Mobil Oil Corporation, New York, N.Y.

[22] Filed: Oct. 5, 1973

[21] Appl. No.: 404,067

[30] Foreign Application Priority Data

Oct. 9, 1972 Netherlands ..... 7213653

[52] U.S. Cl. ..... 137/565; 114/183 R; 137/592; 417/211.5

[51] Int. Cl.[2] ..... E03B 11/16

[58] Field of Search ..... 114/183 R; 137/565, 137/590, 592, 132, 134, 143, 395; 302/15; 417/211.5

[56] References Cited

UNITED STATES PATENTS

| | | | |
|---|---|---|---|
| 661,609 | 11/1900 | Hoover et al. | 302/15 |
| 858,166 | 6/1907 | Eggleston | 137/143 |
| 1,052,034 | 2/1913 | Bowser | 417/211.5 |
| 1,188,159 | 6/1916 | Dittrick | 137/143 |
| 1,831,993 | 11/1931 | Braselton et al. | 417/211.5 |
| 2,673,571 | 3/1954 | Leroni | 137/590 |
| 2,762,202 | 9/1956 | Ponsar | 137/132 |
| 2,917,068 | 12/1959 | Davis | 137/590 |
| 3,159,172 | 12/1964 | Baxter | 137/592 |
| 3,503,384 | 3/1970 | Matarazzo et al. | 137/592 |
| 3,552,435 | 1/1971 | Andersson et al. | 137/592 |

FOREIGN PATENTS OR APPLICATIONS

| | | | |
|---|---|---|---|
| L12,397 | 4/1956 | Germany | 137/592 |
| 273,601 | 4/1913 | Germany | |

*Primary Examiner*—Martin P. Schwadron
*Assistant Examiner*—George L. Walton
*Attorney, Agent, or Firm*—Charles A. Huggett; Malcolm Keen

[57] ABSTRACT

A device for preventing the discharge of sediments and oily liquids from ships ballast tanks. The device comprises a chamber around the suction pipe which communicates with the interior of the suction pipe by apertures above the main suction aperture.

3 Claims, 7 Drawing Figures

FIG. 4
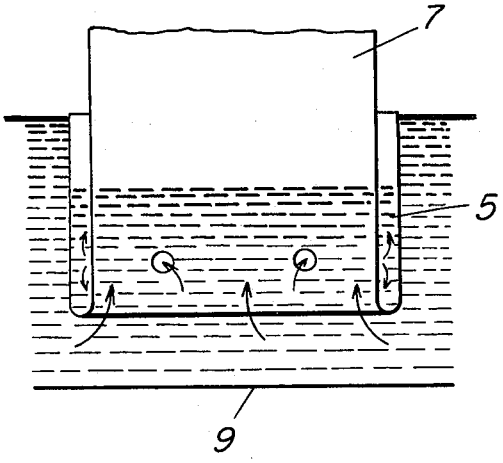
FIG. 5
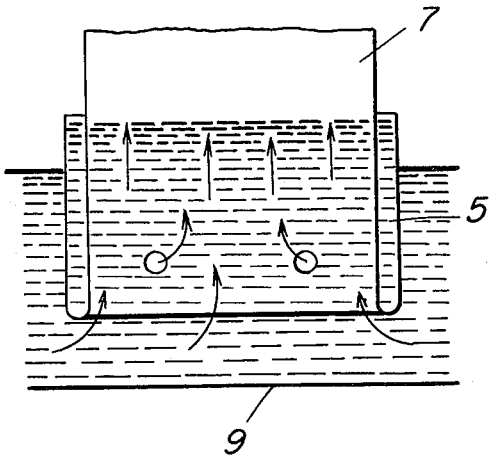
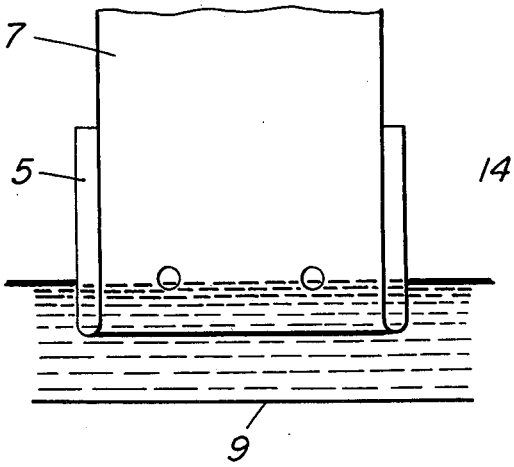
FIG. 6
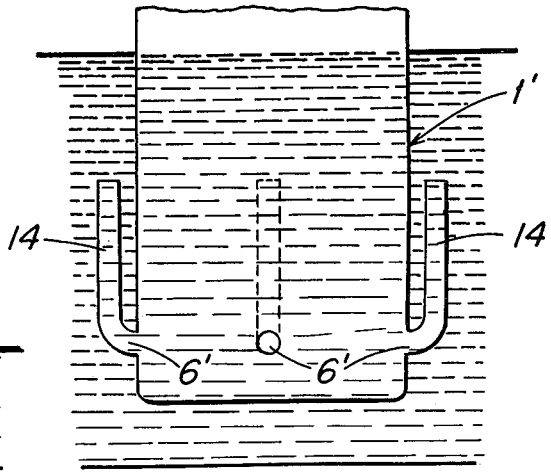
FIG. 7

INTAKE PIECE ADAPTED FOR EMPTYING CONTAINERS WITH LIQUID

GENERAL FIELD OF THE INVENTION

The invention relates to an intake piece adapted for emptying liquids from containers.

THE PRIOR ART

When emptying liquids from containers with suction tubes extending to the bottom of the container it is often necessary to avoid sucking up any sediment at the bottom of the container. Because of this, the intake of the suction tube has to be kept at a substantial distance from the bottom of the container in order to keep the sediment outside the influence of the suction generated in the intake piece. This means that not only the sediment, but also a substantial quantity of the liquid remains in the liquid container.

In the last phase of the emptying process, matter floating on the liquid may also be sucked in. As an example, emptying the ballast tanks of ships, such as oil tankers or other ships, may be mentioned. With such ships sea water is usually used as the ballast water and its corroding influence on the tank walls is inhibited by using a so-called "tank coating", an oily liquid which has the property of closing around the ballast water in the form of an enveloping film. It thereby constitutes a protective layer between the tank walls and the sea water. When emptying such protected ballast tanks, by pumping (which generally occurs in the harbour where the cargo has to be taken on), the portion of the tank coating liquid floating on the ballast water is pumped out in the last phase of the emptying process together with the last of the ballast water. This causes pollution of the harbour basin into which the ballast water is discharged. In some localities this form of pollution has taken such proportions, taking into account the intensive ship traffic, that legal regulations have been made about the discharge of ballast water in harbours.

SUMMARY OF THE INVENTION

The present invention provides an intake piece adapted for emptying liquids from containers. The intake piece permits quick discharge and is adjustable to a very short distance from the bottom of the container to be emptied without the possibility of sucking in sediment at the same time. It also prevents sucking off matter which is floating on the liquid by automatically shutting down the pumping operation.

More particularly, the invention provides an intake piece which is suitable for application in ballast tanks of oil tankers and which permits emptying such ballast tanks in the usual manner by pumps discharging the liquid in a harbour basin without the possibility of pollution by tank coating discharged with the ballast water.

The intake piece apart from preventing the pollution of the harbour basin also offers the advantage of saving tank coating material.

The intake piece according to the present invention comprises a suction or inlet tube which communicates by at least one port, provided in the side wall at a distance above the open end, with an exteriorly situated auxiliary reservoir which further communicates by a second port, positioned at a greater height above the opening edge of the tube length than the first mentioned port, with the space outside the tube.

When emptying a liquid tank, e.g. a ballast tank, by means of such an intake piece, the operation will initially scarcely differ from the operation of a normal suction conduit. The difference then is that with the intake piece according to the invention, the liquid is sucked through the open end and through the port(s) provided in the side wall of the tube. The liquid (ballast water) which is sucked through the port(s) above the open end of the tube from the auxiliary reservoir, is supplemented through the second port. A basically different operation occurs only in the last phase of the emptying process, namely, as soon as the level of the liquid descends to the level of the second or upper port of the auxiliary reservoir. From this moment, the auxiliary reservoir will be rapidly drained and no longer refilled with liquid so that shortly after this moment air is supplied through the side wall port(s) of the suction tube. This leads to an interruption in the pumping operation (e.g. with a ballast pump of the usual type). Thereafter liquid will flow from the liquid container through the side wall port(s) of the suction tube into the auxiliary reservoir. Pump operation is then restored and subsequently interrupted again, and so on. The last phase of the emptying process therefore has an oscillating character with the result that the average suction force in the intake piece is relatively small during the last phase: the last part of the liquid is therefore pumped out more calmly with a reduced possibility of taking along sediment and similar matter. The oscillating pump action continues until the level of the liquid in the container has been lowered to that of the side wall port(s) of the suction tube. From that moment the pump permanently sucks in air so that the pump operation is completely shut down.

The result is that the intake piece remains immersed for a distance equal to the height of the side wall port(s) above the lower open end of the suction tube. It will be clear that when the thickness of the layer floating on the liquid in the liquid container (e.g. tank coating on the ballast water) is smaller than the last mentioned height, this matter necessarily remains in the container.

Further it will be clear that the duration and the frequency of the oscillating pump operation may be influenced by selecting the supplementing port(s) of the auxiliary reservoir at a greater or smaller height and by selecting the contents of the auxiliary reservoir and/or the cross-section of the side wall port(s) of the suction tube greater or smaller relative to the diameter of the tube length.

In a practical embodiment the auxiliary reservoir is constituted by a chamber surrounding the lower portion of the suction tube. This chamber is defined at its inner periphery by the suction tube proper, at its lower edge by an annular bottom portion and at its outer periphery by a cylindrical wall outside and coaxial with the suction tube.

In order to keep the amount of the matter floating on the liquid which may enter the auxiliary reservoir through the supplementing port(s) when the liquid level lowers, as small as possible it may be advantageous to cover the chamber at its open upper end by a wall portion extending outwardly from the exterior of the suction tube length, the arrangement being such that one or more peripheral apertures or a peripheral slot is left open.

Instead of an annular chamber sections of such a chamber could be disposed around the suction tube.

The simplest embodiment of this kind is constituted by an auxiliary tube or tubes joined to the side wall port of the tube length and extending to the desired height above the port.

BRIEF DESCRIPTION OF THE DRAWINGS

The invention will be further explained below by reference to the accompanying drawings, showing two preferred embodiments of the invention.

In the drawings:

FIGS. 1 through 6 show a sectional elevation of an intake piece according to one embodiment of the invention, each of the individual figures showing a different phase of the unloading of the liquid container and FIG. 7 represents a sectional elevation of a modified intake piece according to the invention.

DESCRIPTION OF SPECIFIC EMBODIMENTS

Figure 1:
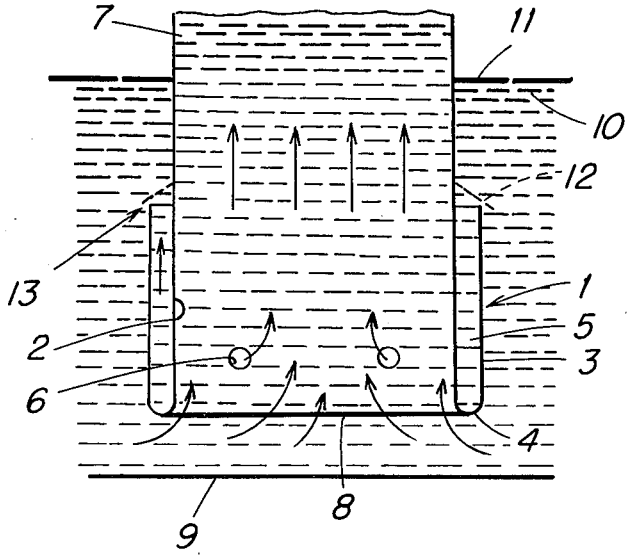

With reference to FIGS. 1 through 6 of the drawings the intake piece 1 comprises a tubular section 2, which is surrounded by a cylindrical wall portion 3. The cylindrical wall portion 3 and the tubular section 2 are connected at their lower ends by means of an annular wall portion 4. The tubular section 2, the cylindrical wall portion 3 and the annular wall portion 4 confine an annular chamber 5 which is open at its upper end. The annular chamber 5 communicates with the space within the annular section 2 through a number of orifices 6 in the tubular section 2 adjacent the lower end of said section.

The intake piece 1 may either constitute a separate piece adapted to be connected to the lower end of a suction pipe (a portion of which is indicated at 7 in the drawings) or may have its tubular section 2 constituted by the lower end of the suction pipe.

The intake piece 1 is positioned within a liquid container (not shown in the drawing), with its intake opening 8 located at a short distance above the bottom 9 of the container, e.g. a ballast tank of a ship.

In the operational phase of FIG. 1 the level of the liquid, e.g. ballast water, in the tank is above the upper end of annular chamber 5 and is indicated at 10. 11 designates a layer, e.g. of a tank coating substance, floating on the body of liquid.

The suction pipe 7 is connected to a pump, e.g. a conventional ballast pump not shown in the drawing. This pump is taking water out of the ballast tank according to the arrows. The main flow of the water from the tank towards the pump passes through intake opening 8, while a smaller flow of water is taken from annular chamber 5 through orifices 6.

Figure 2:
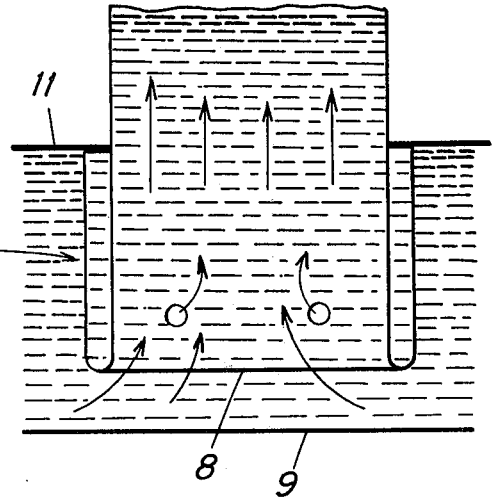
Figure 3:
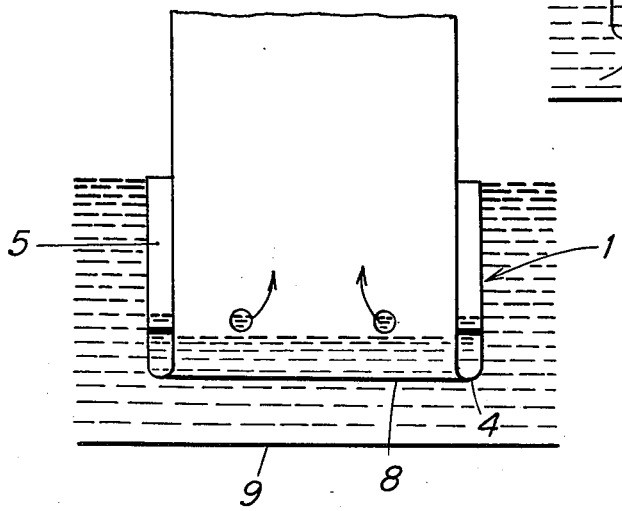

In the unloading phase represented in FIG. 2 the water level 10 with the floating layer 11 on it has sunk to the upper end of annular chamber 5. From this stage the annular chamber is rapidly drained, because no water can enter from the tank into the annular chamber at its upper end. The additional flow through the orifices 6 continues until the stage represented in FIG. 3 is obtained. In this stage the water level in the annular chamber 5 has descended to such an extent that air is sucked through orifices 6, as a result of which the pumping action is interrupted. The pump is of course selected to be of the type which ceases to operate when air is sucked into the inlet. During the time when the pump is shut down, annular chamber 5 is filled up again through orifices 6 as indicated in FIG. 4. This puts the ballast pump into operation again (FIG. 5) until the chamber is drained for the second time (FIG. 6). This intermittent pumping action continues until the water level 10 within the tank has lowered to the shut down level within chamber 5. At that time the ballast pump will constantly draw in air and will shut down completely.

Consequently the layer 11 floating on the remainder of the ballast water in the tank will never reach the main intake opening 8 of the intake piece and is kept within the tank.

A small portion of layer 11 may enter into chamber 5 through its open upper end, but in view of the limited cross-sectional area of chamber 5, its amount is negligible.

If desired, the proportion of layer 11 which enters chamber 5, may be reduced by applying an annular baffle 12, indicated by dotted lines in FIG. 1. This baffle covers the upper end of annular chamber 5 and leaves only a narrow circumferential opening 13.

In the modified construction shown in FIG. 7, the function of annular chamber 5 in the embodiment of FIGS. 1 through 6 is fulfilled by a number of tubes 14, each of which extend from an orifice 6' upwardly to a level, at which the ballast pump shifts from a continuous action to an intermittent one during the final phase of the discharge of the ballast water from the tank.

Although the invention has been described with reference to particular preferred embodiments thereof, it will be understood that other embodiments according to its spirit and scope will be apparent to those skilled in the art.

I claim:

1. In a system for discharging liquid from a container portion of a vessel, said container portion having a top and a floor, said system comprising liquid pumping means connected to an inlet suction tube extending substantially vertically into said container from the top of said container, the tube having an open lower end adjacent the floor of said container, the improvement comprising at least one first port adjacent to and spaced from said open end of said inlet tube and disposed in the wall of said inlet tube, and a reservoir having a closed bottom and situated exteriorly of said inlet tube, the reservoir comprising a chamber surrounding said inlet tube adjacent said open end, said chamber defined by said inlet tube, a cylindrical wall member surrounding said inlet tube and a lower annular wall portion extending between said inlet tube and said cylindrical wall adjacent said open end, the interior of said reservoir defined by the exterior of the inlet tube and the cylindrical wall member being in fluid flow communication with the interior of said inlet tube through said at least one first port, said reservoir terminating above said at least one first port and adjacent the floor of said container, said reservoir having at least one second port positioned above said at least one first port and adjacent the floor of said container, said at least one second port permitting fluid flow communication between the interior of said reservoir and the space surrounding said reservoir.

2. In a system for discharging liquid from a container portion of a vessel, said container portion having a top and a floor, said system comprising liquid pumping means connected to an inlet suction tube extending substantially vertically into said container from the top of said container, the tube having an open lower end adjacent the floor of said container, the improvement comprising at least one second tube situated exteriorly of said inlet tube and having a lower end and an upper end and open at both said upper and lower ends, the lower end of said second tube being in fluid flow communication with the interior of said inlet tube through a first port adjacent to and spaced from said open end of said inlet tube and disposed in the wall of said inlet tube, said second tube extending upwardly from said first port to said open upper end at a level above said first port and adjacent said floor of said container to define a second port permitting fluid flow communication between the interior of the second tube and the space surrounding said second tube.

3. The method of discharging liquids from containers while minimising the discharge of material supernatant upon said liquids, comprising the steps of:

1. creating suction in an inlet tube extending substantially vertically into a container holding said liquids, by means of pumping means connected to said inlet tube, said inlet tube extending into said container from the top thereof and having an open lower end adjacent the floor thereof,
2. withdrawing said liquids through said inlet tube from said container through said open end of said inlet tube,
3. continuing to withdraw said liquids until the level of said liquids in said container falls to the top of a reservoir disposed exteriorly of said tube, said reservoir having a closed bottom and an interior space defined by the exterior walls of said inlet tube and the walls of the reservoir and in fluid flow communication with the interior of said inlet tube through at least one first porting aperture situated above and adjacent to said open end of said inlet tube, said top of said reservoir having at least one second porting aperture permitting fluid flow communication between said interior of said reservoir and the space surrounding said reservoir, said second porting aperture being at a level above said first porting aperture and adjacent said floor of said container, 4. withdrawing liquids from said reservoir through said at least one first porting aperture whereby the level of liquids in said reservoir falls relatively faster than the level of said liquids in said container portion exteriorly of said reservoir,
5. continuing to withdraw said liquids from said reservoir until the level of liquids in said reservoir falls to said at least one first porting aperture whereby air is admitted to said inlet tube through said at least one first porting aperture, and thereupon terminating the withdrawal of said liquids through said inlet tube,
6. passing liquid into said reservoir from said container through said at least one first porting aperture until the level of liquids within said reservoir is equal to that of said liquids in said container exteriorly of said reservoir and above said first porting aperture,
7. resuming the withdrawal of liquids through said inlet tube by the creation of suction therein, and
8. repeating steps (4) through (7) until the level of said liquids in said container exteriorly of said reservoir is at the level of said first porting aperture and thereupon terminating said withdrawal of liquids.

* * * * *